US005753051A

United States Patent [19]

Kanai et al.

[11] Patent Number: 5,753,051

[45] Date of Patent: *May 19, 1998

[54] ORIENTED ELECTRICAL STEEL SHEET HAVING LOW CORE LOSS AND METHOD OF MANUFACTURING SAME

[75] Inventors: Takao Kanai; Kei Tanemoto, both of Kawasaki; Shuichi Yamazaki; Takeo Nagashima, both of Futtsu, all of Japan

[73] Assignee: Nippon Steel Corporation, Tokyo, Japan

[ * ] Notice: The term of this patent shall not extend beyond the expiration date of Pat. No. 5,679,177.

[21] Appl. No.: 788,437

[22] Filed: Jan. 28, 1997

Related U.S. Application Data

[60] Continuation of Ser. No. 380,729, Jan. 30, 1995, Pat. No. 5,679,177, which is a division of Ser. No. 17,673, Feb. 12, 1993, Pat. No. 5,411,808.

[30] Foreign Application Priority Data

Feb. 13, 1992 [JP] Japan ..... 4-26972
Aug. 21, 1992 [JP] Japan ..... 4-222850

[51] Int. Cl.[6] ..... H01F 1/04

[52] U.S. Cl. ..... 148/113; 148/122

[58] Field of Search ..... 148/113, 122

[56] References Cited

U.S. PATENT DOCUMENTS 4,681,813 7/1987 Yamada et al. ..... 428/472
5,045,350 9/1991 Benford et al. ..... 427/127
5,129,965 7/1992 Kobayashi et al. ..... 148/113
5,141,573 8/1992 Nakashima ..... 148/111

FOREIGN PATENT DOCUMENTS 52-24499 7/1977 Japan .
53-28375 8/1978 Japan .
56-4150 1/1981 Japan .
58-26405 6/1983 Japan .
61-201732 9/1986 Japan .
62-86175 4/1987 Japan .
63-54767 10/1988 Japan .
2-213483 8/1990 Japan .
2-243770 9/1990 Japan .
3-130376 6/1991 Japan .

*Primary Examiner*—John Sheehan
*Attorney, Agent, or Firm*—Wenderoth, Lind & Ponack

[57] ABSTRACT

Low core loss oriented electrical steel sheet having a surface coating that has a Young's modulus that is not less than 100 GPa and a differential of thermal expansion coefficient relative to the sheet base metal that is not less than $2\times10^{-6}$/K and which contains not less than 10 percent, by weight, of crystallites with an average size of not less than 10 nm and an average crystal grain diameter that does not exceed 1000 nm, and a method of manufacturing same.

24 Claims, No Drawings

ORIENTED ELECTRICAL STEEL SHEET HAVING LOW CORE LOSS AND METHOD OF MANUFACTURING SAME

This is a continuation of Ser. No. 08/380,729 filed Jan. 30, 1995, now U.S. Pat. No. 5,679,177 which is a divisional application of Ser. No. 08/017,673 filed Feb. 12, 1993, now U.S. Pat. No. 5,411,808.

BACKGROUND OF THE INVENTION

1. Field of the Invention

The present invention relates to oriented electrical steel sheet having a surface coating that includes a crystalline phase, and to a method of manufacturing same. The invention particularly relates to oriented electrical steel sheet in which core loss properties are markedly improved by a surface coating that has good adhesion and imparts a high degree of tension to the sheet base metal, and to a method for manufacturing same.

2. Description of the Prior Art

Oriented electrical steel sheet is extensively used as a material for magnetic cores. To reduce energy loss it is necessary to reduce core loss. JP-B-58-26405 discloses a method for reducing the core loss of oriented electrical steel sheet consisting of using a laser beam to impart localized stress to the sheet surface, following finish annealing, to thereby refine the size of the magnetic domains. JP-A-62-86175 discloses an example of a means of also refining magnetic domains so as not to lose the effect of stress relief annealing applied following core processing.

On the other hand, it is known that the application of tension to oriented electrical steel sheet degrades core loss properties. Oriented electrical steel sheet usually has a primary coating of forsterite formed during finish annealing (secondary recrystallization), and a secondary coating of phosphate formed on the primary layer. These layers impart tension to the steel sheet and contribute to reducing the core loss. However, because the tension imparted by the coating has not been enough to produce a sufficient reduction in core loss, there has been a need for coatings that will provide a further improvement in core loss properties by imparting a higher tension.

Methods of providing a greater improvement in core loss properties include the method described by JP-B-52-24499 which comprises following the completion of finish annealing by the application of the above primary coating and the removal of the oxide layer that is located near the surface of the steel sheet and impedes domain movement, flattening the base metal surface and providing a mirror surface finish which is then metal-plated, while the further provision of a tension coating is described by, for example, JP-B-56-4150, JP-A-61-201732, JP-B-63-54767, and JP-A-2-213483. While the greater the tension produced by the coating, the greater the improvement in core loss properties, the mirror surface finish produces a pronounced degradation in the adhesion of the coating to the steel sheet. This has led to the proposed use of various techniques to form the coating, such as physical vapor deposition, chemical vapor deposition, sputtering, ion plating, ion implantation, flame spraying and the like.

While it is recognized that films formed by physical vapor deposition, chemical vapor deposition, sputtering, ion plating and the like have good adhesion and that the tension thus imparted improves the core loss properties to a fair degree, these processes require a high vacuum and it takes a considerable time to obtain a film thick enough for practical application. Thus, such processes have the drawbacks of very low productivity and high cost, while for the purposes of forming coatings on electrical steel sheet, ion implantation and flame spraying cannot really be described as industrial techniques.

A coating method that is industrially applicable is the sol-gel method. JP-A-2-243770, for example, relates to the formation of an oxide coating, while JP-A-3-130376 describes a method of forming a thin gel coating on the surface of steel sheet that has been flattened, followed by the formation of an insulating layer. While it is possible to form coatings with such techniques, using the same application and baking processes as those of the prior art, as described in each of the specifications it is very difficult to form a sound coating having a thickness of not less than 0.5 μm.

In order to obtain a coating of the thickness needed to impart a high degree of tension, repeated applications and heat treatments are required, and it has also been necessary to use another technique to form a coating on the sol-gel coating.

SUMMARY OF THE INVENTION

The object of the present invention is therefore to provide an oriented electrical steel sheet in which very low core loss is achieved by means of a surface coating that imparts sufficient tension to the steel sheet and has good adhesion even to a surface that has been given a mirror surface finish, and to an industrially feasible method for manufacturing same.

DETAILED DESCRIPTION OF THE INVENTION

In accordance with the present invention the above object is achieved by oriented electrical steel sheet provided with a surface coating that has a Young's modulus of not less than 100 GPa and/or a differential of thermal expansion coefficient of not less than $2\times10^{-6}$/K compared to the sheet base metal, and which contains not less than 10 percent, by weight, of crystallites having an average size of not less than 10 nm ant an average crystal grain diameter that does not exceed 1000 nm. With such a coating the steel sheet is provided with a high degree of tension and core loss is reduced.

JP-B-53-28375 describes a large differential between the thermal expansion coefficient of the steel sheet and the coating, a large modulus of elasticity and good adhesion as desirable characteristics for a coating used to impart a high degree of tension to steel sheet. Such properties can be achieved by a coating having a Young's modulus of not less than 100 GPa and a differential of thermal expansion coefficient of not less than $2\times10^{-6}$/K compared to the sheet base metal, and which contains not less than 10 percent, by weight, of crystallites having an average size of not less than 10 nm and an average crystal grain diameter that does not exceed 1000 nm.

To achieve a high degree of tension, it is preferable to have a Young's modulus of not less than 150 GPa and a differential of thermal expansion coefficient of not less than $4\times10^{-6}$/K, and more preferably a Young's modulus of not less than 200 GPa and a differential of thermal expansion coefficient of not less than $6\times10^{-6}$/K. A coating having a crystalline structure that satisfies such Young's modulus and differential of thermal expansion coefficient conditions imparts very high tension and enables a low core loss to be achieved.

The reason for defining an average crystallite size of not less than 10 nm is that, because in the case of an amorphous phase most of the formation takes place as a result of the melting and cooling steps of the heat treatment process, the melting point is not so high and the properties of the coating can be changed by partial reheating in the following stress relief annealing process. Also, the inclusion of the crystalline phase results in a stable coating that does not undergo change even during stress relief annealing.

Components that have the above crystalline properties and can impart a high degree of tension to steel sheet include oxides, nitrides, carbides, nitrous oxides and the like that contain one or more elements selected from lithium, boron, magnesium, aluminum, silicon, phosphorus, titanium, vanadium, manganese, iron, cobalt, nickel, copper, zinc, zirconium, tin, and barium.

Of these, the crystalline properties described above are satisfied by $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZnO.SiO_2$, $ZrO_2.SiO_2$, $ZrO_2.TiO_2$, $9Al_2O_3.2B_2O_3$, $2Al_2O_3.B_2O_3$, $2MgO.2Al_2O_3.5SiO_2$, $Li_2O.Al_2O_3.2SiO_2$, $Li_2O.Al_2O_3.4SiO_2$, and $BaO.Al_2O_3.SiO_2$, which may be used singly or as a combination of two or more.

Of these, $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $9Al_2O_3.2B_2O_3$, $2Al_2O_3.B_2O_3$, $2MgO.2Al_2O_3.5SiO_2$, $Li_2O.Al_2O_3.2SiO_2$ and $Li_2O.Al_2O_3.4SiO_2$ are crystalline phase compounds that can be used to produce a marked reduction in core loss by imparting a high tension.

The core loss of the steel sheet will he lowered by a coating that contains not less than 10 percent of the above crystalline phase components. However, to impart stable, high tension it is preferable to use a content of not less than 30 percent, and more preferably not less than 50 percent.

As the coating is usually inorganic the properties thereof depend on the microstructure of the grain as well as on the crystal components. The imparting of tension to the steel sheet subjects the coating to compressive forces. To be able to withstand these forces and impart a high degree of tension, preferably the size of the constituent crystal grains of the coating should not exceed 1000 nm, and more preferably should not exceed 500 nm.

The surface coating of the oriented electrical steel sheet having a low core loss according to the present invention contains from 5 percent to less than 90 percent, by weight, of crystalline components satisfying the above requirements (hereinafter "crystalline phase (A)"), other crystalline components (hereinafter "crystalline phase (B)"), and amorphous phase components. Crystalline phase (B) is produced during the heat treatment process by reaction with crystalline phase (A) and other components. Crystalline phase (B) does not satisfy the (crystalline phase (A) requirements with respect to properties such as the Young's modulus and thermal expansion coefficient, and as such accounts for a low degree of the tension imparted to the steel sheet. However, because it markedly improves the adhesion between coating and sheet produced in the heat treatment process, it is an indispensable component of the tension coating. In particular, when a tension coating is formed on the surface of steel sheet that has been given a mirror surface finish to achieve a major reduction in core loss, adhesion is markedly improved by the inclusion of the crystalline phase (B) of the present invention. There is no particular limitation on crystalline phase (B) components; any component produced by the above reaction may be used.

Adhesion is also improved by the amorphous phase in the tension coating. The amorphous phase is produced by the melting of part of the crystalline phase (B) components or other non-crystalline-phase-(A) coating components during a separate heat treatment process. While there is no particular limitation on amorphous phase components, a glass phase such as borosilicate glass or phosphate glass in which boron and phosphorus form a single component is ideal for imparting heat resistance, stability and tension.

The coating contains, by weight, from 5 percent to less than 90 percent crystalline phase (B) and amorphous phase. In coexistence with crystalline phase (A) an amorphous phase content of less than 90 percent is possible. However, because the components thereof do not directly impart tension, it is preferable to use a content of from 5 percent to less than 70 percent, and more preferably 5 percent to less than 50 percent.

Although there is no particular limitation on the thickness of the coating formed on the steel sheet, from the viewpoint of imparting sufficient tension the coating is not less than 0.3 μm thick, and more preferably is not less than 0.5 μm thick. In the case of sheet that is less than 9 mil thick and on which too thick a coating is undesirable because it reduces the space factor, the thickness of the coating should be not more than 5 μm, and preferably not more than 3 μm.

The coating may be formed directly on the base metal of the sheet following the completion of secondary recrystallization annealing, or on the primary coating of forsterite and secondary phosphate coating produced by the secondary recrystallization annealing.

An example of a coating which gives excellent tensile stresses that contribute to lowering the core loss is one having a crystalline phase (A) comprised of $9Al_2O_3.2B_2O_3$ and/or $2Al_2O_3.B_2O_3$, and an amorphous phase comprised of a glass phase of boron and unavoidable components. $9Al_2O_3.2B_2O_3$ and $2Al_2O_3.B_2O_3$ each have a Young's modulus of about 200 GPa and a thermal expansion coefficient of $4\times10^{-6}$/K or so, a differential of $8\times10^{-6}$/K or more relative to the steel sheet. The boron glass phase markedly improves the adhesion of the coating by forming borosilicate glass or alumino-borosilicate glass.

Described below are examples of methods of manufacturing the low core loss oriented electrical steel sheet according to the present invention.

In accordance with a first method, after the completion of secondary recrystallization annealing a sol coating is applied and heated and formed onto the surface of the steel sheet. The sol is comprised of component (A) with a Young's modulus of not less than 100 GPa and/or a differential of thermal expansion coefficient of $2\times10^{-6}$/K or more relative to the base metal, thereby providing the required tensioning effect.

While any component that has a Young's modulus of not less than 100 GPa and a differential of thermal expansion coefficient of $2\times10^{-6}$/K may be used as component (A), normally a ceramic precursor particle component is used. Here, "ceramic precursor particle" is a general term for any particle that becomes a ceramic when heat treated. Examples include metal oxides, hydrates of metal oxides, metal hydroxides, oxalates, carbonates, nitrates and sulfates, and compounds thereof.

Component (A) can be constituted by $MgO$, $Al_2O_3$, $SiO_2$, $TiO_2$, $ZnO$, $ZrO_2$, $BaO$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $ZrO_2.TiO_2$, $ZnO.SiO_2$, $2MgO.2Al_2O_3.5SiO_2$, $Li_2O.Al_2O_3.2SiO_2$, $Li_2O.Al_2O_3.4SiO_2$ and $BaO.Al_2O_3.SiO_2$, and precursors thereof, singly or as a combination of two or more.

There is also no particular limitation on the properties of the sols that can be used. To obtain a coating that with a single application and heat treatment has good adhesion and is thick enough to impart the required tension, the component (A) should be comprised of particles with a diameter that is not less than 10 nm and not more than 1500 nm, and the pH of the sol should be adjusted to not more than 6.5 and not less than 8.0. To suppress the cracking and degradation in adhesion that have been problems with conventional methods, the present method is based on the novel concept described below and is not an extension of conventional sol-gel coating techniques.

Conventional sol-gel coating methods can be broadly divided into two types. In one method an organic metal compound such as metal alkoxide and minute particles are subjected to condensation polymerization to form a gel network. The other method is the colloid process, in which the sol is synthesized from a solution in which larger colloid particles are dispersed, and the stability of the sol is gradually reduced to obtain a gel, which is baked.

To obtain a coating that is thick enough to provide sufficient tension with just one application and heat treatment is difficult with the condensation polymerization process, in which formation of the network and the following drying process are accompanied by shrinkage. In the case of a thin coating, a sound coating can be obtained owing to the fact that as the adhesive force between the coating and the steel sheet exceeds the shrinkage force, shrinkage occurs mainly perpendicular to the surface of the coating (the sheet surface). In the case of a thick coating, however, the shrinkage force exceeds the adhesive force, causing the coating to peel and crack.

While there are similar problems with the colloid process, compared to the condensation polymerization process it is easier to form a thick coating. In the colloid process in which the gel is obtained from the sol by chemical means such as pH adjustment and physical means such as heat-drying, it is possible to moderate drying-based shrinkage (which is mainly caused by the coagulation of particles) by controlling the drying conditions to modify the colloid particle arrangement.

In the case of a sol containing a relatively high concentration of colloid particles that are stably dispersed by the repulsive force of the particles (ideally, by electrostatic repulsion), there is less solvent and therefore less shrinkage during the drying process. Also, as the repulsive force between particles makes it possible to minimize particle coagulation during drying, it is possible to form a coating that is much thicker than the coating that can be formed with the condensation polymerization process. Thus, with just one application and heat treatment it is possible to obtain a coating that is thick enough to provide a high degree of tension.

For the colloid process, the particles should have a diameter that is not less than 10 nm, and preferably not less than 30 nm. With particles 1500 nm or more in diameter it becomes very difficult to form a stable sol and can easily result in non-uniform gel/coating. Therefore preferably the particles should not be larger than 1000 nm in diameter, and more preferably not larger than 500 nm. The size of the sol particles should also be adjusted in accordance with the surface conditions of the steel sheet. For flat steel sheet, a coating with outstanding adhesion can be obtained by using a sol with smaller particles, within the above limits.

The pH of the sol is adjusted to be not more than 6.5 or not less than 8.0, which has the above-described effect of causing particles to be mutually repelled by electrostatic force. The isoelectric point of ceramic precursor particles (the point at which the particle surface charge becomes zero) is usually in the neutral region. Therefore adjusting the pH to 6.5 or less causes negatively charged anions to adhere to the surface of positively charged particles, forming double electrical layers that are in a mutually-repelling steady state. However, by maintaining the sol at a pH of not less than 8, a stable dispersion can be obtained with particles such as silicon oxide in which the isoelectric point is at a pH region of around 2. A sol pH that is outside these limits reduces particle repulsion, making it difficult to obtain a high concentration sol. In addition it causes particles to coagulate, and during the gel drying process the force of this coagulation acting parallel to the coating surface causes cracking and results in a non-uniform coating. A pH that is very high or very low can cause oxidation of the steel sheet during the application and baking of the sol, so a pH of 2 to 5.5 or 8.0 to 12.5, is preferable.

Any steel sheet may be used that has undergone finish annealing and secondary recrystallization. Steel sheet may be used on which normal finish annealing has resulted in the formation of a primary coating of forsterite and a secondary coating of phosphate. Steel sheets that may be used include sheet in which the primary coating has been removed to expose the base metal surface for the purpose of achieving a large decrease in core loss, sheet that has been given a mirror surface finish by chemical or electrolytic polishing, flattening annealing or other such means, and sheet that has not been subjected to a process that produces a primary coating and in which the metal surface is therefore in the exposed state following secondary recrystallization.

The sol is applied by a known method such as roll coating, dipping, or electrophoresis, and is then dried to form a gel, which is heat treated. While there is no particular limitation on the heat treatment temperature within the range in which a coating is formed, it is preferable to use a temperature that is within the range 500° C. to 1350° C., and more preferably within the range 500° C. to 1200° C. While there is no particular limitation on the heat treatment atmosphere, if there is a need to avoid oxidization of the steel sheet the heat treatment can be done in an inert gas such as nitrogen or in a mixture of nitrogen and hydrogen or other such reducing gas atmosphere. Also, when the coating is to be formed on steel sheet on which the metal surface has been exposed, adhesion can be markedly improved by the introduction of a little water vapor into the atmosphere, but there is no objection to using an atmosphere with a suitable dew point.

In a second method of manufacturing the steel sheet according to the present invention, a suspension consisting of component (A) and a component (B) that has a coating formation temperature lowering effect produced by reaction in the heat treatment process with at least one selected from the non-component-(A) coating formation components and the base metal components of the steel sheet, is applied to, and formed on, the surface of steel sheet that has been finish-annealed. In the heat treatment process, component (B) is partially or wholly transformed into a different component by reaction with one selected from the other coating formation components in the suspension and the base metal components of the steel sheet, thereby increasing the tensioning effect and producing a marked strengthening of the adhesion between the coating and the steel. The resultant component has the effect of lowering the coating formation temperature. This can be advantageously used when a high degree of tension and a marked improvement in adhesion are observed when the above-described reaction products and the component (B) are melted in a separate balking process.

There are no particular limitations on the component (B) other than it satisfies the above requirements. However, formation can be enhanced by adding at least part of the component (B) in the form of a solution so as to achieve a more uniform mix with the component (A). For this, a room-temperature solubility in water of 0.1 percent is preferable, and 0.5 percent more preferable.

A pronounced lowering of the coating formation temperature is provided by a component (B) comprised of one, two or more compounds containing at least one component selected from lithium, boron, fluorine and phosphorus. The component (B) may also have a catalytic action that is manifested even at low content levels. In terms of the solid content of the sol, the component (B) content is 0.01 percent or more, preferable 0.1 percent or more, and more preferably 0.5 percent or more. A component (B) content that is too high degrades the tensioning effect, so the upper limit is set at not more than 70 percent, and preferably not more than 50 percent.

The suspension used in this method may be a sol, a stable particle dispersion system such as that represented by a colloid, or a slurry of ceramic precursor particles. As the coating solution used to impart good tension and appearance, it is preferable to use a sol having the controlled particle size and pH described with reference to the first manufacturing method. The steel sheet, method of application, heat treatment conditions and the like used for the first manufacturing method may be employed without modification in the second manufacturing method.

In accordance with a second manufacturing method, a suspension consisting of components (A) and (B), and a component (C) that improves the adhesion between the coating and the steel sheet by promoting the formation of an oxide layer on the surface of the base metal, is applied to, and formed on, the surface of steel sheet that has been finish-annealed. Interposing an oxide layer between the coating and the steel sheet is an effective means of producing adhesion. Component (C) is provided to facilitate the efficient formation of this oxide layer in the baking process.

The application of a suspension that contains not less than 0.01 percent and less than 10 percent, and more preferably not less than 0.01 percent and less than 5 percent, of one, two or more compounds that include as the (C) component one or more elements selected from titanium, vanadium, manganese, iron, cobalt, nickel, copper, and tin, produces an oxide layer and thereby enhances the adhesion between the coating and the steel sheet. A component (C) content that is below the lower limit will not provide sufficient adhesion, and while exceeding the limit will result in good adhesion, it also degrades surface flatness and makes it difficult to reduce core loss.

Examples of the present invention are described below. However, the invention is not limited to these examples.

EXAMPLE 1

The sols listed in Table 1 were produced by the following method. Uniform $Al_2O_3$ sols were obtained by adding distilled water to commercial boehmite powder (Dispal, made by Condea Vista Japan, Inc.) and stirring. For the $SiO_2$, $TiO_2$ and $ZrO_1$ sols, the pH of commercial sols (made by Nissan Chemical, etc.) were adjusted as required. Compound oxide sols were obtained by mixing the above oxide sols to produce a compound oxide composition which was then stirred to make the mixture uniform. The MgO component in the form of a fine powder obtained by the hydrolysis of magnesium diethoxide, the BaO component in the form of a sol produced by the hydrolysis of barium methoxide obtained by dissolving metallic barium in methanol, and the ZnO component in the form of a commercial fine powder product were each dispersed and the pH thereof adjusted. Commercial lithium silicate was used to form $Li_2O.Al_2O_3.2SiO_2$ and $Li_2O.Al_2O_3.4SiO_2$.

The above sols were applied to steel sheet 0.2 mm thick containing 3.3 percent by weight of silicon and on which a forsterite coating (primary coating) had formed following finish annealing, and to steel sheet with a surface coating of phosphate (secondary coating), to form a coating of about 5 grams per square meter after heat treatment. Each sol was then dried to form a gel, and this was followed by heat treatment for 60 seconds at 1000° C. in a nitrogen atmosphere to obtain a homogeneous coating. Coating properties are listed in Table 1. Metallic silicon powder, which has excellent crystallinity, was used as a standard to calculate the size of the crystallites based on the peak width spread.

The coatings exhibited outstanding appearance and adhesion. Listed in Table 1 are applied tension values calculated by removing the formed coating from one surface and measuring the resulting curvature, the magnetic flux density at 800 A/m ($B_8$) before and after coating formation, and core loss. From this data it can be seen that the coating produced a marked improvement in core loss values.

TABLE 1

| Sol properties | | | | Coating properties | | | | | | Tension & magnetic properties | | |
|---|---|---|---|---|---|---|---|---|---|---|---|---|
| Component (A) | Sol particle diameter (nm) | pH | Steel sheet application surface | Tension component | Young's modulus (GPa) | Thermal expansion coefficient ($10^{-6}$/K.) | Crystallite size (nm) | Crystal grain size (nm) | Applied tensile stress (kgf/mm) | $B_8$ (T) | $W_{17/50}$ (W/kg) |
| $Al_2O_3$ | 800 | 5.5 | On primary coating | $Al_2O_3$ | 400 | 3.2 | 50 | 900 | 1.2 | (Before) 1.938<br>(After) 1.921 | 0.82<br>0.63 |
| $Al_2O_3$ | 300 | 4.5 | On secondary coating | $Al_2O_3$ | 400 | 3.2 | 40 | 500 | 1.3 | (Before) 1.933<br>(After) 1.919 | 0.78<br>0.61 |
| $SiO_2$ | 20 | 3.0 | On primary | $SiO_2$ | 80 | 11.0 | 20 | 100 | 1.1 | (Before) 1.936<br>(After) 1.918 | 0.83<br>0.65 |

TABLE 1-continued

| Sol properties | | | | Coating properties | | | | | | Tension & magnetic properties | | |
|---|---|---|---|---|---|---|---|---|---|---|---|---|
| Component (A) | Sol particle diameter (nm) | pH | Steel sheet application surface | Tension component | Young's modulus (GPa) | Thermal expansion coefficient ($10^{-6}$/K.) | Crystallite size (nm) | Crystal grain size (nm) | Applied tensile stress (kgf/(mm) | $B_8$ (T) | $W_{17/50}$ (W/kg) |
| | | | coating | | | | | | | | |
| $SiO_2$ | 15 | 3.0 | On secondary coating | $SiO_2$ | 80 | 11.0 | 20 | 100 | 1.3 | (Before) 1.931<br>(After) 1.915 | 0.79<br>0.60 |
| $TiO_2$ | 30 | 10.5 | On primary coating | $TiO_2$ | 290 | 4.4 | 40 | 150 | 1.2 | (Before) 1.937<br>(After) 1.924 | 0.81<br>0.65 |
| $ZrO_2$ | 20 | 9.5 | On primary coating | $ZrO_2$ | 140 | 1.1 | 30 | 120 | 1.1 | (Before) 1.935<br>(After) 1.921 | 0.82<br>0.66 |
| $MgO.Al_2O_3$ | 1000 | 5.0 | On primary coating | $MgO.Al_2O_3$ | 250 | 3.6 | 100 | 1000 | 1.4 | (Before) 1.935<br>(After) 1.917 | 0.81<br>0.63 |
| $MgO.Al_2O_3$ | 1000 | 5.0 | On secondary coating | $MgO.Al_2O_3$ | 250 | 3.6 | 100 | 1000 | 1.5 | (Before) 1.929<br>(After) 1.914 | 0.79<br>0.61 |
| $2MgO.SiO_2$ | 500 | 3.5 | On primary coating | $2MgO.SiO_2$ | 220 | 1.0 | 70 | 900 | 1.2 | (Before) 1.936<br>(After) 1.916 | 0.83<br>0.65 |
| $2MgO.TiO_2$ | 600 | 10.0 | On primary coating | $2MgO.TiO_2$ | 20 | 2.0 | 70 | 900 | 1.0 | (Before) 1.939<br>(After) 1.920 | 0.80<br>0.64 |
| $3Al_2O_3.2SiO_2$ | 500 | 4.0 | On primary coating | $3Al_2O_3.2SiO_2$ | 150 | 7.1 | 80 | 1000 | 1.4 | (Before) 1.934<br>(After) 1.916 | 0.83<br>0.63 |
| $3Al_2O_3.2SiO_2$ | 500 | 4.0 | On secondary coating | $3Al_2O_3.2SiO_2$ | 150 | 7.1 | 80 | 1000 | 1.4 | (Before) 1.936<br>(After) 1.917 | 0.79<br>0.60 |
| $ZrO_2.SiO_2$ | 20 | 9.0 | On primary coating | $ZrO_2.SiO_2$ | 100 | 6.5 | 20 | 200 | 1.3 | (Before) 1.938<br>(After) 1.919 | 0.84<br>0.65 |
| $ZrO_2.SiO_2$ | 20 | 9.0 | On secondary coating | $ZrO_2.SiO_2$ | 100 | 6.5 | 20 | 200 | 1.4 | (Before) 1.935<br>(After) 1.918 | 0.79<br>0.63 |
| $ZnO.SiO_2$ | 1000 | 4.0 | On primary coating | $ZnO.SiO_2$ | 100 | 8.8 | 100 | 1000 | 1.2 | (Before) 1.937<br>(After) 1.921 | 0.85<br>0.66 |
| $2MgO.2Al_2O_3.5SiO_2$ | 800 | 3.0 | On primary coating | $2MgO.2Al_2O_3.5SiO_2$ | 80 | 6.3 | 50 | 1000 | 1.4 | (Before) 1.937<br>(After) 1.918 | 0.81<br>0.62 |
| $2MgO.2Al_2O_3.5SiO_2$ | 800 | 3.0 | On secondary coating | $2MgO.2Al_2O_3.5SiO_2$ | 80 | 6.3 | 50 | 1000 | 1.5 | (Before) 1.932<br>(After) 1.914 | 0.78<br>0.61 |
| $Li_2O.Al_2O_3.2SiO_2$ | 600 | 11.0 | On primary coating | $Li_2O.Al_2O_3.2SiO_2$ | 60 | 10.3 | 20 | 800 | 1.5 | (Before) 1.940<br>(After) 1.925 | 0.82<br>0.63 |
| $Li_2O.Al_2O_3.2SiO_2$ | 600 | 11.0 | On secondary coating | $Li_2O.Al_2O_3.2SiO_2$ | 60 | 10.3 | 20 | 800 | 1.6 | (Before) 1.934<br>(After) 1.920 | 0.79<br>0.61 |
| $BaO.Al_2O_3.SiO_2$ | 500 | 4.5 | On primary coating | $BaO.Al_2O_3.SiO_2$ | 100 | 8.6 | 30 | 650 | 1.3 | (Before) 1.936<br>(After) 1.918 | 0.81<br>0.64 |

EXAMPLE 2

The same sols as those used in example 1 were produced. After being finish-annealed, 0.2-mm-thick oriented electrical steel sheet having a high magnetic flux density and containing 3.3 percent by weight of silicon was immersed in a mixture of sulfuric acid and hydrofluoric acid to remove the forsterite coating (primary coating) and expose the base metal, and a solution containing hydrofluoric acid and hydrogen peroxide was then used to give the base metal surface a mirror surface finish. Also, an annealing separator of alumina was applied and this was followed by finish annealing to thereby obtain high-magnetic-flux-density oriented electrical steel sheet with a mirror surface finish without forming a forsterite coating. The sols were applied to these steel sheets to form a coating of about 5 grams per square meter after being heat treated. Each sol was then dried to form a gel which was heat treated for 60 seconds at 850° C. in a nitrogen atmosphere to form a homogeneous coating.

Coating properties of electrical steel sheets are listed in Table 2. From this data it can be seen that the coating produced a marked improvement in core loss values.

TABLE 2

| Sol properties | | | | Coating properties | | | | | | Tension & magnetic properties | | |
|---|---|---|---|---|---|---|---|---|---|---|---|---|
| Component (A) | Sol particle diameter (nm) | pH | Steel sheet application surface | Tension component | Young's modulus (GPa) | Thermal expansion coefficient ($10^{-6}$/K.) | Crystallite size (nm) | Crystal grain size (nm) | Applied tensile stress (kgf/(mm) | $B_8$ (T) | $W_{17/50}$ (W/kg) |
| $Al_2O_3$ | 200 | 4.5 | Mirror surface finish (Acid treatment) | $Al_2O_3$ | 400 | 3.2 | 30 | 300 | 1.3 | (Before) 1.929<br>(After) 1.911 | 0.89<br>0.69 |
| $Al_2O_3$ | 600 | 5.0 | Mirror surface finish (Almina separator) | $Al_2O_3$ | 400 | 3.2 | 50 | 800 | 1.3 | (Before) 1.926<br>(After) 1.909 | 1.15<br>0.83 |
| $SiO_2$ | 20 | 3.0 | Mirror surface finish (Acid treatment) | $SiO_2$ | 80 | 11.0 | 20 | 100 | 1.2 | (Before) 1.928<br>(After) 1.913 | 0.88<br>0.70 |
| $SiO_2$ | 25 | 3.0 | Mirror surface finish (Almina separator) | $SiO_2$ | 80 | 11.0 | 25 | 120 | 1.3 | (Before) 1.924<br>(After) 1.908 | 1.13<br>0.85 |
| $TiO_2$ | 30 | 10.5 | Mirror surface finish (Almina separator) | $TiO_2$ | 290 | 4.4 | 40 | 130 | 1.1 | (Before) 1.931<br>(After) 1.913 | 0.86<br>0.65 |
| $ZrO_2$ | 20 | 9.5 | Mirror surface finish (Acid treatment) | $ZrO_2$ | 140 | 1.1 | 20 | 100 | 1.1 | (Before) 1.930<br>(After) 1.914 | 0.87<br>0.68 |
| $MgO.Al_2O_3$ | 400 | 4.5 | Mirror surface finish (Acid treatment) | $MgO.Al_2O_3$ | 250 | 3.6 | 70 | 550 | 1.3 | (Before) 1.928<br>(After) 1.912 | 0.89<br>0.67 |
| $MgO.Al_2O_3$ | 500 | 5.0 | Mirror surface finish (Almina separator) | $MgO.Al_2O_3$ | 250 | 3.6 | 80 | 700 | 1.4 | (Before) 1.925<br>(After) 1.911 | 1.18<br>0.86 |
| $2MgO.SiO_2$ | 300 | 3.0 | Mirror surface finish (Acid treatment) | $2MgO.SiO_2$ | 220 | 1.0 | 40 | 450 | 1.2 | (Before) 1.931<br>(After) 1.916 | 0.88<br>0.65 |
| $2MgO.TiO_2$ | 450 | 9.5 | Mirror surface finish (Almina separator) | $2MgO.TiO_2$ | 20 | 2.0 | 50 | 600 | 1.1 | (Before) 1.925<br>(After) 1.910 | 1.12<br>0.84 |
| $3Al_2O_3.2SiO_2$ | 300 | 3.5 | Mirror surface finish | $3Al_2O_3.2SiO_2$ | 150 | 7.1 | 40 | 400 | 1.4 | (Before) 1.927<br>(After) 1.914 | 0.90<br>0.66 |
| $3Al_2O_3.2SiO_2$ | 400 | 4.0 | Mirror surface finish (Almina separator) | $3Al_2O_3.2SiO_2$ | 150 | 7.1 | 60 | 500 | 1.3 | (Before) 1.926<br>(After) 1.911 | 1.16<br>0.84 |
| $ZrO_2.SiO_2$ | 20 | 9.0 | Mirror surface finish (Acid treatment) | $ZrO_2.SiO_2$ | 100 | 6.5 | 20 | 200 | 1.3 | (Before) 1.929<br>(After) 1.913 | 0.88<br>0.67 |
| $ZrO_2.SiO_2$ | 20 | 9.0 | Mirror surface finish (Almina separator) | $ZrO_2.SiO_2$ | 100 | 6.5 | 20 | 200 | 1.3 | (Before) 1.928<br>(After) 1.915 | 1.13<br>0.85 |
| $ZnO.SiO_2$ | 600 | 4.0 | Mirror | $Zno.SiO_2$ | 100 | 8.8 | 50 | 750 | 1.2 | (Before) 1.930 | 0.86 |

TABLE 2-continued

| Sol properties | | | | Coating properties | | | | | | Tension & magnetic properties | | |
|---|---|---|---|---|---|---|---|---|---|---|---|---|
| Component (A) | Sol particle diameter (nm) | pH | Steel sheet application surface | Tension component | Young's modulus (GPa) | Thermal expansion coefficient ($10^{-6}$/K.) | Crystallite size (nm) | Crystal grain size (nm) | Applied tensile stress (kgf/(mm) | $B_8$ (T) | $W_{17/50}$ (W/kg) |
| | | | surface finish (Acid treatment) | | | | | | | (After) 1.917 | 0.65 |
| $2MgO.2Al_2O_3.5SiO_2$ | 500 | 3.0 | Mirror surface finish (Acid treatment) | $2MgO.2Al_2O_3.5SiO_2$ | 80 | 6.3 | 40 | 700 | 1.4 | (Before) 1.928<br>(After) 1.914 | 0.87<br>0.64 |
| $2MgO.2Al_2O_3.5SiO_2$ | 600 | 3.0 | Mirror surface finish (Almina) (separator) | $2MgO.2Al_2O_3.5SiO_2$ | 80 | 6.3 | 40 | 900 | 1.4 | (Before) 1.925<br>(After) 1.911 | 1.16<br>0.84 |
| $Li_2O.Al_2O_3.2SiO_2$ | 600 | 11.0 | Mirror surface finish (Acid treatment) | $Li_2O.Al_2O_3.2SiO_2$ | 60 | 10.3 | 20 | 750 | 1.4 | (Before) 1.927<br>(After) 1.913 | 0.88<br>0.66 |
| $Li_2O.Al_2O_3.2SiO_2$ | 600 | 11.0 | Mirror surface finish (Almina separator) | $Li_2O.Al_2O_32SiO_2$ | 60 | 10.3 | 20 | 750 | 1.5 | (Before) 1.925<br>(After) 1.914 | 1.14<br>0.86 |
| $BaO.Al_2O_3.SiO_2$ | 400 | 4.0 | Mirror surface finish (Acid treatment) | $BaO.Al_2O_3.SiO_2$ | 100 | 8.6 | 30 | 500 | 1.2 | (Before) 1.930<br>(After) 1.915 | 0.89<br>0.65 |

EXAMPLE 3

The components listed in Table 3 as component (B) and component (C) were added to the sols produced by the same methods used in example 1 to form a coating liquid. This was applied to the two types of coated sheets of example 1 and the two types of mirror-surfaced sheets of example 2 to form a coating of about 5 grams per square meter after heat treatment. Each was then dried to form a gel which was baked for 60 seconds at 900° C. in a nitrogen—hydrogen atmosphere to form a homogeneous coating.

Coating properties of electrical steel sheets are listed in Table 3. From this data it can be seen that the coating produced a marked improvement in core loss values.

TABLE 3

| Sol properties | | | | | |
|---|---|---|---|---|---|
| Component (A) | Sol particle diameter (nm) | pH | Component (B)<br>Component (C) | | Steel sheet application surface |
| $Al_2O_3$ | 200 | 4.5 | $HBO_2$ | 25 wt % | On primary coating |
| | | | — | | |
| $Al_2O_3$ | 400 | 5.0 | $HBO_2$ | 10 wt % | On secondary coating |
| | | | — | | |
| $Al_2O_3$ | 100 | 4.0 | $HBO_2$ | 30 wt % | Mirror surface finish |
| | | | FeOOH | 0.5 wt % | (Acid treatment) |
| $Al_2O_3$ | 150 | 4.0 | $HBO_2$ | 30 wt % | Mirror surface finish |
| | | | FeOOH | 0.5 wt % | (Almina separator) |
| $MgO.Al_2O_3$ | 800 | 4.5 | LiF | 3 wt % | On primary coating |
| $MgO.Al_2O_3$ | 800 | 4.5 | LiF | 3 wt % | On secondary coating |
| $MgO.Al_2O_3$ | 400 | 4.0 | $Al(H_2PO_4)_3$ | 10 wt % | Mirror surface finish |
| | | | | | (Acid treatment) |
| $MgO.Al_2O_3$ | 500 | 4.5 | $Al(H_2PO_4)_3$ | 10 wt % | Mirror surface finish |
| | | | | | (Almina separator) |

TABLE 3-continued

| Coating properties | | | | | | Tension & magnetic properties | | |
|---|---|---|---|---|---|---|---|---|
| Tension component | Young's modulus (GPa) | Thermal expansion coefficient ($10^{-6}$/K.) | Crystal-lite size (nm) | Crystal grain size (nm) | Others | Applied tensile stress (kgf/mm) | $B_8$ (T) | $W_{17/50}$ (W/kg) |
| $9Al_2O_3.2B_2O_3$ | 200 | 7.6 | 30 | 300 | None | 1.6 | (Before) 1.934 | 0.84 |
| $2Al_2O_3.B_2O_3$ | 200 | 7.8 | 30 | | | | (After) 1.922 | 0.63 |
| $2Al_2O_3.B_2O_3$ | 200 | 7.8 | 40 | 500 | None | 1.5 | (Before) 1.931 | 0.79 |
| | | | | | | | (After) 1.919 | 0.65 |
| $Al_2O_3$ | 400 | 3.2 | 50 | | | | | |
| $2Al_2O_3.B_2O_3$ | 200 | 7.8 | 30 | 150 | None | 1.8 | (Before) 1.928 | 0.88 |
| | | | | | | | (After) 1.914 | 0.69 |
| $2Al_2O_3.B_2O_3$ | 200 | 7.8 | 30 | 180 | None | 1.8 | (Before) 1.925 | 1.10 |
| | | | | | | | (After) 1.911 | 0.82 |
| $MgO.Al_2O_3$ | 250 | 3.6 | 60 | 1000 | None (Amorphous) | 1.5 | (Before) 1.934 | 0.86 |
| | | | | | | | (After) 1.919 | 0.64 |
| $MgO.Al_2O_3$ | 250 | 3.6 | 60 | 1000 | None (Amorphous) | 1.5 | (Before) 1.936 | 0.82 |
| | | | | | | | (After) 1.916 | 0.61 |
| $MgO.Al_2O_3$ | 250 | 3.6 | 50 | 700 | $AlPO_4$ $Mg_3(PO_4)_2$ | 1.6 | (Before) 1.930 | 0.88 |
| | | | | | | | (After) 1.915 | 0.65 |
| $MgO.Al_2O_3$ | 250 | 3.6 | 50 | 900 | $AlPO_4$ $Mg_3(PO_4)_2$ | 1.7 | (Before) 1.924 | 1.14 |
| | | | | | | | (After) 1.912 | 0.83 |

| Sol properties | | | | | |
|---|---|---|---|---|---|
| Component (A) | Sol particle diameter (nm) | pH | Component (B) Component (C) | | Steel sheet application surface |
| $3Al_2O_3.2SiO_2$ | 600 | 4.0 | $Al(H_2PO_4)_3$ | 5 wt % | On primary coating |
| $3Al_2O_3.2SiO_2$ | 500 | 4.0 | $Al(H_2PO_4)_3$ | 5 wt % | On secondary coating |
| $3Al_2O_3.2SiO_2$ | 400 | 4.0 | LiF | 2 wt % | Mirror surface finish (Acid treatment) |
| $3Al_2O_3.2SiO_2$ | 300 | 3.5 | LiF | 2 wt % | Mirror surface finish (Almina separator) |
| $ZrO_2.SiO_2$ | 20 | 9.5 | $Li_2B_4O_7$ | 5 wt % | Mirror surface finish (Acid treatment) |
| $ZrO_2.SiO_2$ | 20 | 9.5 | $Li_2B_4O_7$ | 5 wt % | Mirror surface finish (Almina separator) |
| $2MgO.2Al_2O_3.5SiO_2$ | 800 | 4.0 | $HBO_2$ | 20 wt % | On primary coating |
| $2MgO.2Al_2O_3.5SiO_2$ | | | | | |
| $2MgO.2Al_2O_3.5SiO_2$ | 800 | 4.0 | $HBO_2$ | 20 wt % | On secondary coating |
| $2MgO.2Al_2O_3.5SiO_2$ | 400 | 3.0 | $HBO_2$ | 30 wt % | Mirror surface finish |
| | | | $TiO_2$ | 1 wt % | (Acid treatment) |
| $2MgO.2Al_2O_3.5SiO_2$ | 500 | 3.0 | $HBO_2$ | 30 wt % | Mirror surface finish |
| | | | $TiO_2$ | 1 wt % | (Almina separator) |

| Coating properties | | | | | | Tension & magnetic properties | | |
|---|---|---|---|---|---|---|---|---|
| Tension component | Young's modulus (GPa) | Thermal expansion coefficient ($10^{-6}$/K.) | Crystal-lite size (nm) | Crystal grain size (nm) | Others | Applied tensile stress (kgf/mm) | $B_8$ (T) | $W_{17/50}$ (W/kg) |
| $3Al_2O_3.2SiO_2$ | 150 | 7.1 | 60 | 900 | $AlPO_4$ | 1.7 | (Before) 1.933 | 0.85 |
| | | | | | | | (After) 1.918 | 0.63 |
| $3Al_2O_3.2SiO_2$ | 150 | 7.1 | 60 | 800 | $AlPO_4$ | 1.7 | (Before) 1.936 | 0.81 |
| | | | | | | | (After) 1.924 | 0.62 |
| $3Al_2O_3.2SiO_2$ | 150 | 7.1 | 50 | 500 | None (Amorphous) | 1.6 | (Before) 1.927 | 0.89 |
| | | | | | | | (After) 1.912 | 0.68 |
| $3Al_2O_3.2SiO_2$ | 150 | 7.1 | 50 | 450 | None (Amorphous) | 1.5 | (Before) 1.929 | 1.17 |
| | | | | | | | (After) 1.914 | 0.84 |
| $ZrO_2.SiO_2$ | 100 | 6.5 | 20 | 400 | None (Amorphous) | 1.6 | (Before) 1.927 | 0.88 |
| | | | | | | | (After) 1.911 | 0.65 |
| $ZrO_2.SiO_2$ | 100 | 6.5 | 20 | 400 | None (Amorphous) | 1.7 | (Before) 1.925 | 1.14 |
| | | | | | | | (After) 1.910 | 0.83 |
| $2MgO.2Al_2O_3.5SiO_2$ | 80 | 6.3 | 60 | 1000 | None (Amorphous) | 1.7 | (Before) 1.934 | 0.87 |
| | | | | | | | (After) 1.921 | 0.64 |
| $2Al_2O_3.B_2O_3$ | 200 | 7.8 | 50 | | | | | |
| $2MgO.2Al_2O_3.5SiO_2$ | 80 | 6.3 | 60 | 1000 | None (Amorphous) | 1.8 | (Before) 1.936 | 0.81 |
| | | | | | | | (After) 1.925 | 0.60 |
| $2Al_2O_3.B_2O_3$ | 200 | 7.8 | 50 | | | | | |
| $2MgO.2Al_2O_3.5SiO_2$ | 80 | 6.3 | 40 | 700 | None (Amorphous) | 1.8 | (Before) 1.926 | 0.88 |
| | | | | | | | (After) 1.913 | 0.65 |
| $2Al_2O_3.B_2O_3$ | 200 | 7.8 | 50 | | | | | |
| $2MgO.2Al_2O_3.5SiO_2$ | 80 | 6.3 | 40 | 800 | None (Amorphous) | 1.8 | (Before) 1.922 | 1.15 |
| | | | | | | | (After) 1.910 | 0.82 |
| $2Al_2O_3.B_2O_3$ | 200 | 7.8 | 50 | | | | | |

What is claimed is:

1. A method of manufacturing low core loss oriented electrical steel sheet with a coating thereon, which comprises preparing a sol comprised of a component (A) that is at least one member selected from the group consisting of $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $ZrO_2.TiO_2$, $ZnO.SiO_2$, $2MgO.2Al_2O_3.5SiO_2$, $Li_2O.Al_2O_3.2SiO_2$, $Li_2O.Al_2O_3.4SiO_2$ and $BaO.Al_2O_3.SiO_2$, applying the sol on the surface of steel sheet that has been secondary recrystallized, drying the sol to form a gel, and heat treating the steel sheet.

2. The method claimed in claim 1, in which the component (A) is comprised of ceramic precursor particles with a diameter that is not less than 10 nm and not more than 1500 nm, and pH of the sol is adjusted to not more than 6.5 or not less than 8.0.

3. A method of manufacturing low core loss oriented electrical steel sheet with a coating thereon, which comprises preparing a suspension comprised of a component (A) that is at least one member selected from the group consisting of $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $ZrO_2.TiO_2$, $ZnO.SiO_2$, $2MgO.2Al_2O_3.5SiO_2$, $Li_2O.Al_2O_3.2SiO_2$, $Li_2O.Al_2O_3.4SiO_2$ and $BaO.Al_2O_3.SiO_2$, and a component (B) that is or includes at least one member selected from the group consisting of lithium, boron, fluorine and phosphorus, applying the suspension on the surface of steel sheet that has been secondary recrystallized, drying the applied suspension to form a gel, and heat treating the steel sheet.

4. The method claimed in claim 3, in which the component (B) in the suspension has a solubility in water at room temperature of 0.1 percent or more and at least part is dissolved in water.

5. A method of manufacturing a low core loss oriented electrical steel sheet having a surface coating that has a Young's modulus that is not less than 100 GPa and/or a differential of thermal expansion coefficient relative to the sheet base metal that is not less than $2\times10^{-6}$/K and which contains not less than 10 percent, by weight, of crystallites with an average size of not less than 10 nm and an average crystal grain diameter that does not exceed 1000 nm, the method comprising preparing a sol that is constituted by a component (A) that remains a constituent component in the formed coating and gives a tensile stress to a base metal sheet provided by a Young's modulus that is not less than 100 GPa and a differential of thermal expansion coefficient relative to the base metal that is not less than $2\times10^{-6}$/K, and applying and heat treating the sol on the surface of a steel sheet that has been secondary-recrystallized.

6. A method according to claim 5, in which the component (A) is comprised of ceramic precursor particles with a diameter that is not less than 10 nm and not more than 1500 nm, and a sol is used in which the pH is adjusted to not more than 6.5 and not less than 8.0.

7. A method according to claim 5, in which component (A) is at least one member selected from the group consisting of $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $ZrO_2.TiO_2$, $ZnO.SiO_2$, $2MgO.2Al_2O_3.5SiO_2$, $Li_2O.Al_2O_3.2SiO_2$, $Li_2O.Al_2O_3.4SiO_2$ and $BaO.Al_2O_3.SiO_2$.

8. A method of manufacturing a low core loss oriented electrical steel sheet having a surface coating comprised of not less than 10 percent and less than 95 percent, by weight, of crystals that have a Young's modulus that is not less than 100 GPa and/or differential of thermal expansion coefficient relative to the sheet base metal that is not less than $2\times10^{-6}$/K and which contains not less than 10 percent, by weight, of crystallites with an average size of not less than 10 nm, and not less than 5 percent and less than 90 percent of crystals that do not satisfy the said conditions and which are produced by reaction of the said crystals with other coating composition components and/or base metal sheet components, and an average crystal grain diameter that does not exceed 1000 nm, the method comprising preparing a suspension comprised of a component (A) that remains a constituent component in the formed coating and gives a tensile stress to a base metal sheet provided by a Young's modulus that is not less than 100 GPa and a differential of thermal expansion coefficient relative to the base metal that is not less than $2\times10^{-6}$/K, and a component (B) that has an effect of lowering the formation temperature of the coating produced by reaction in a heat treatment process with at least one member selected from the group consisting of other components in the coating and base metal components of the steel sheet, applying the suspension on a surface of a steel sheet that has been finish-annealed, drying the applied suspension to form a gel, and heat treating the resultant steel sheet.

9. A method of manufacturing a low core loss oriented electrical steel sheet having a surface coating comprised of not less than 10 percent and less than 95 percent, by weight, of crystals that have a Young's modulus that is not less than 100 GPa and/or differential of thermal expansion coefficient relative to the sheet base metal that is not less than $2\times10^{-6}$/K and which contains not less than 10 percent, by weight, of crystallites with an average size of not less than 10 nm, and not less than 5 percent and less than 90 percent of crystals that do not satisfy the said conditions and which are produced by reaction of the said crystals with other coating composition components and/or base metal sheet components, and an average crystal grain diameter that does not exceed 1000 nm, the method comprising preparing a suspension comprised of a component (A) that remains a constituent component in the formed coating and gives a tensile stress to a base metal sheet provided by a Young's modulus that is not less than 100 GPa and a differential of thermal expansion coefficient relative to the base metal that is not less than $2\times10^{-6}$/K, and a component (B) that has the effect of lowering the formation temperature of the coating in which the main element is component (A), by being at least partially melted in a heat treatment process, applying the suspension on a surface of a steel sheet that has been finish-annealed, drying the applied suspension to form a gel, and heat treating the resultant steel sheet.

10. A method according to claim 8, in which the component (B) in the suspension has a solubility in water at room temperature of 0.1 percent or more and at least part is dissolved in water.

11. A method according to claim 8, in which component (B) is comprised of at least one compound that includes at least one component selected from the group consisting of lithium, boron, fluorine and phosphorus.

12. A method of manufacturing a low core loss oriented electrical sheet having a surface coating comprised of not less than 10 percent and less than 95 percent, by weight, of crystals that have a Young's modulus that is not less than 100 GPa and/or differential of thermal expansion coefficient relative to the sheet base metal that is not less than $2\times10^{-6}$/K and which contains not less than 10 percent, by weight, of crystallites with an average size of not less than 10 nm, and not less than 5 percent and less than 90 percent of crystals that do not satisfy the said conditions and which are produced by reaction of the said crystals with other coating composition components and/or base metal sheet components, and an average crystal grain diameter that does not exceed 1000 nm.

the method comprising preparing a suspension comprised of a component (A) that remains a constituent component in the formed coating and gives a tensile stress to a base metal sheet provided by a Young's modulus that is not less than 100 GPa and a differential of thermal expansion coefficient relative to the base metal that is not less than $2\times10^{-6}$/K, a component (B) that has the effect of lowering the formation temperature of a coating produced by reaction in a baking process with at least one member selected from the group consisting of other components in the coating and base metal components of the steel sheet, and a component (C) that improves adhesion of the coating by promoting the formation of an oxide layer on the base metal surface that is in contact with the coating, applying the suspension on a surface of a steel sheet that has been finish-annealed, drying the applied suspension to form a gel, and heat treating the resultant steel sheet.

13. A method of manufacturing a low core loss oriented electrical sheet having a surface coating comprised of not less than 10 percent and less than 95 percent, by weight, of crystals that have a Young's modulus that is not less than 100 GPa and/or differential of thermal expansion coefficient relative to the sheet base metal that is not less than $2\times10^{-6}$/K and which contains not less than 10 percent, by weight, of crystallites with an average size of not less than 10 nm, and not less than 5 percent and less than 90 percent of crystals that do not satisfy the said conditions and which are produced by reaction of the said crystals with other coating composition components and/or base metal sheet components, and an average crystal grain diameter that does not exceed 1000 nm.

the method comprising preparing a suspension comprised of a component (A) that remains a constituent component in the formed coating and gives a tensile stress to a base metal sheet provided by a Young's modulus that is not less than 100 GPa and a differential of thermal expansion coefficient relative to the base metal that is not less than $2\times10^{-6}$/K, a component (B) that has the effect of lowering the formation temperature of a coating in which the main element is component (A), by being at least partially melted in a heat treatment process, and a component (C) that improves adhesion of the coating by promoting the formation of an oxide layer on the base metal surface that is in contact with the coating, applying the suspension on a surface of a steel sheet that has been finish-annealed, drying the applied suspension to form a gel, and heat treating the resultant steel sheet.

14. A method according to claim 12, in which component (C) is comprised of at least one compound that includes at least one member selected from the group consisting of titanium, vanadium, manganese, iron, cobalt, nickel, copper and tin.

15. A method according to claim 13, in which component (C) is comprised of at least one compound that includes at least one member selected from the group consisting of titanium, vanadium, manganese, iron, cobalt, nickel, copper and tin.

16. A method according to claim 8, in which the surface coating is comprised of not less than 10 percent and less than 95 percent, by weight, of crystallites with an average size of not less than 10 nm, and not less than 5 percent and less than 90 percent of an amorphous phase formed mainly by melting in a baking process, and in which the average crystal grain diameter does not exceed 1000 nm.

17. A method according to claim 9, in which the surface coating is comprised of not less than 10 percent and less than 95 percent, by weight, of crystallites with an average size of not less than 10 nm, and not less than 5 percent and less than 90 percent of an amorphous phase formed mainly by melting in a baking process, and in which the average crystal grain diameter does not exceed 1000 nm.

18. A method according to claim 12, in which the surface coating is comprised of not less than 10 percent and less than 95 percent, by weight, of crystallites with an average size of not less than 10 nm, and not less than 5 percent and less than 90 percent of an amorphous phase formed mainly by melting in a baking process, and in which the average crystal grain diameter does not exceed 1000 nm.

19. A method according to claim 13, in which the surface coating is comprised of not less than 10 percent and less than 95 percent, by weight, of crystallites with an average size of not less than 10 nm, and not less than 5 percent and less than 90 percent of an amorphous phase formed mainly by melting in a baking process, and in which the average crystal grain diameter does not exceed 1000 nm.

20. A method according to claim 5, in which the crystal component that has a Young's modulus that is not less than 100 GPa and a differential of thermal expansion coefficient relative to the sheet base metal that is not less than $2\times10^{-6}$/K is comprised of at least one compound containing at least one component selected from the group consisting of lithium, boron, magnesium, aluminum, silicon, phosphorus, titanium, vanadium, manganese, iron, cobalt, nickel, copper, zinc, zirconium, tin and barium.

21. A method according to claim 5, in which the crystal component that has a Young's modulus that is not less than 100 GPa and a differential of thermal expansion coefficient relative to the sheet base metal that is not less than $2\times10^{-6}$/K is at least one compound selected from the group consisting of $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZnO.SiO_2$, $ZrO_2.SiO_2$, $ZnO_2.TiO_2$, $9Al_2O_3.2B_2O_3$, $2Al_2O_3.B_2O_3$, $2MgO.2Al_2O_3.5SiO_2$, $Li_2O.Al_2O_3.2SiO_2$, $Li_2O.Al_2O_3.4SiO_2$ and $BaO.Al_2O_3.SiO_2$.

22. A method according to claim 5, in which the crystal component that has a Young's modulus that is not less than 100 GPa and a differential of thermal expansion coefficient relative to the sheet base metal that is not less than $2\times10^{-6}$/K is at least one compound selected from the group consisting of $Al_2O_3$, $SiO_2$, $TiO_2$, $ZrO_2$, $MgO.Al_2O_3$, $2MgO.SiO_2$, $MgO.SiO_2$, $2MgO.TiO_2$, $MgO.TiO_2$, $MgO.2TiO_2$, $Al_2O_3.SiO_2$, $3Al_2O_3.2SiO_2$, $Al_2O_3.TiO_2$, $ZrO_2.SiO_2$, $9Al_2O_3.2B_2O_3$, $2Al_2O_3.B_2O_3$, $2MgO.2Al_2O_3.5SiO_2$, $Li_2O.Al_2O_3.2SiO_2$ and $Li_2O.Al_2O_3.4SiO_2$.

23. A method according to claim 15, in which the amorphous phase formed mainly by melting is a glass phase in which boron and phosphorus form a single component.

24. A method according to claim 15, in which the crystal component that has a Young's modulus that is not less than 100 GPa and a differential of thermal expansion coefficient relative to the sheet base metal that is not less than $2\times10^{-6}$/K is $9Al_2O_3.2B_2O_3$ or $2Al_2O_3.B_2O_3$ and the amorphous phase is a glass phase with boron forming a single component.

* * * * *